US006357354B1

(12) United States Patent
Dauer et al.

(10) Patent No.: US 6,357,354 B1
(45) Date of Patent: Mar. 19, 2002

(54) METHOD AND APPARATUS FOR FITTING A PRINTING PLATE TO A PLATE CYLINDER

(75) Inventors: Horst Dauer, Rohrbach; Peer Dilling, Friedberg; Godber Petersen, Augsburg; Josef Schneider, Diedorf, all of (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 09/406,597

(22) Filed: Sep. 24, 1999

(30) Foreign Application Priority Data

Sep. 29, 1998 (DE) ..... 198 44 560

(51) Int. Cl.[7] ..... B41L 47/14; B41F 27/12

(52) U.S. Cl. ..... 101/477; 101/378; 101/415.1; 101/375

(58) Field of Search ..... 101/415.1, 477, 101/375, 376, 378, 389.1, 382.1, 383, 216, 217, DIG. 36

(56) References Cited

U.S. PATENT DOCUMENTS

| | | | | |
|---|---|---|---|---|
| 3,430,561 A | | 3/1969 | Simmons | 101/415.1 |
| 3,893,394 A | * | 7/1975 | Fusco et al. | 101/415.1 |
| 4,313,378 A | * | 2/1982 | Etchell et al. | 101/415.1 |
| 4,823,693 A | * | 4/1989 | Köbler | 101/375 |
| 5,488,903 A | | 2/1996 | Köbler et al. | 101/375 |
| 5,492,059 A | | 2/1996 | Reichel | 101/375 |
| 5,513,568 A | | 5/1996 | Hoffmann et al. | 101/375 |
| 5,555,809 A | * | 9/1996 | Hirt et al. | 101/451 |
| 5,687,647 A | * | 11/1997 | Vrotacoe et al. | 101/375 |
| 5,711,222 A | | 1/1998 | Taylor et al. | 101/383 |
| 5,732,630 A | * | 3/1998 | Puschnerat et al. | 101/415.1 |
| 5,791,244 A | * | 8/1998 | Tognino | 101/415.1 |
| 5,921,183 A | * | 7/1999 | Jones | 101/415.1 |

FOREIGN PATENT DOCUMENTS

| | | | |
|---|---|---|---|
| DE | 1 960 635 | 6/1971 | B41F/27/12 |
| DE | 4315909 A1 | 12/1993 | B41F/13/20 |
| DE | 43 15 996 | 8/1994 | B41F/27/06 |
| DE | 43 23 750 | 1/1995 | B41F/27/12 |
| DE | 4404758 C2 | 8/1995 | B41F/27/12 |
| DE | 19801689 A1 | 8/1998 | B41F/27/12 |
| EP | 0 812 686 | 6/1997 | B41F/27/12 |
| EP | 0812686 A2 | 12/1997 | B41F/27/12 |
| JP | 6-328657 | 11/1994 | B41F/7/02 |
| JP | 7-68736 | 3/1995 | B41F/27/06 |
| JP | 7-195668 | 8/1995 | |
| JP | 10-52907 | 2/1998 | B41F/27/06 |

* cited by examiner

*Primary Examiner*—Leslie J. Grohusky
(74) *Attorney, Agent, or Firm*—Cohen, Pontani, Lieberman & Pavane

(57) ABSTRACT

A method and apparatus for fitting a printing plate to a plate cylinder where the printing plate is bent into a circular shape and fixed in this form by leading and trailing legs of the plate being firmly connected to each other. The printing plate shaped in this way is subsequently axially pushed onto the plate cylinder from the free side of the plate cylinder.

7 Claims, 7 Drawing Sheets

METHOD AND APPARATUS FOR FITTING A PRINTING PLATE TO A PLATE CYLINDER

BACKGROUND OF THE INVENTION

1. Field of the Invention

The invention relates to printing machines, and more particularly to a method and an apparatus for fitting a printing plate, especially an offset printing plate, to an overhung plate cylinder of a rotary printing machine.

2. Description of the Related Art

DE 43 15 909 A1 shows a printing unit in which the plate cylinders are fitted with printing-plate sleeves. During printing operation, the plate cylinders are mounted on both sides in side walls. In order to change the printing-plate, supporting elements are removed from one side wall, after which the plate cylinders are overhung in the other side wall. The plate sleeves can than be drawn off the plate cylinders at the exposed sides of the latter and changed.

Plate sleeves advantageously consist of stainless steel, nickel or a nickel alloy, for example Hastelloy, and are well suited for erasable image-setting. In addition, these materials have good strength values. Plate sleeves of this type are clamped onto the plate cylinder by means of a press fit. In order to displace the plate sleeves for the purpose of changing them, they are usually expanded by means of compressed air.

Non-erasable printing plates advantageously consist of aluminium, and it is known to produce plate sleeves of this type from a butt-welded metal sheet. An apparatus which carries out a shaping and a joining step is needed for this. Such an apparatus is complicated and expensive, thus, production of plate sleeves of this type is correspondingly expensive.

EP-0 812 686 A2 shows an apparatus with which flat printing plates can be fitted axially to an overhung plate cylinder. For this purpose, the printing plates are pushed into a tube and, together with the tube, are pushed onto the plate cylinder over a mandrel, which expands the printing plate. As a result of the actuation of a plate clamping device, the printing plate is then clamped on the plate cylinder and the tube is removed from the plate cylinder. The disadvantage in this case is that the tube rests on the pre-imaged surface of the printing plate and, as a result, can cause damage to the printing surface.

DE 44 04 758 C2 refers to circularly bending a flat printing plate by hand, holding its legs together with an adhesive and subsequently pushing the printing plate axially onto a plate cylinder. The pushed on printing plate is then clamped by means of a clamping system.

SUMMARY OF THE INVENTION

The invention is based on the object of fitting overhung plate cylinders of a rotary printing machine cost-effectively with printing plates. Another object, is to enable flat printing plates to be clamped cost-effectively and reliably.

This and other objects are achieved in accordance with an embodiment of the invention, wherein flat printing plates can be cost-effectively imparted a sleeve shape, and enables these sleeves to be clamped by being axially pushed onto the plate cylinder. The production of these printing plates is compatible with development systems for printing plates which are common nowadays and can be found on the market. In various embodiments of the invention, there is also the possibility of clamping these printing plates using clamping systems for sleeves. The possibility is opened up of clamping sleeves and flat printing plates formed into sleeves, as desired, on a plate cylinder and, in addition, of choosing between erasable and non-erasable printing plates. The ability of the printing machine to be varied is therefore increased with a low outlay on costs. In addition, changing the printing plate axially by pushing it with the web threaded, reduces lost time. It is also possible for printing machines up to specific web widths to be designed in a space-saving manner without operating space between the printing units.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

The invention is to be explained in more detail below using some exemplary embodiments. In the associated drawings.

DETAILED DESCRIPTION OF THE PRESENTLY PREFERRED EMBODIMENTS

Figure 1:
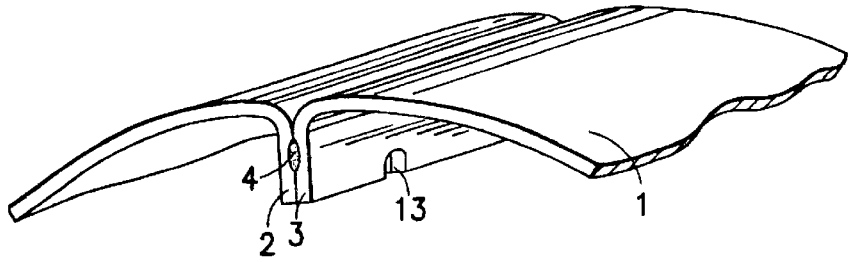
FIG. 1 is a plan view of a printing plate having vertical plate legs welded together.
Figure 2:
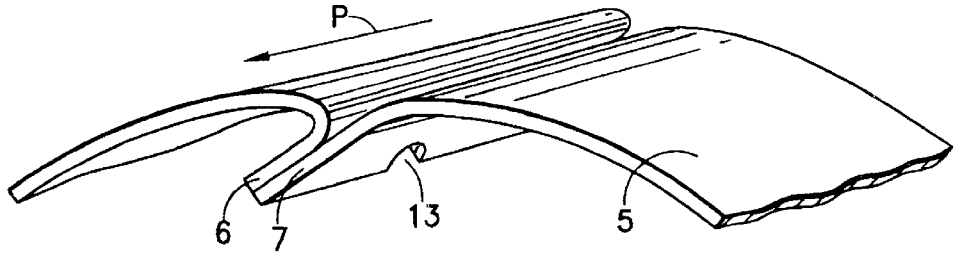
FIG. 2 is a plan view of a printing plate having oblique plate legs bonded together.
Figure 3:
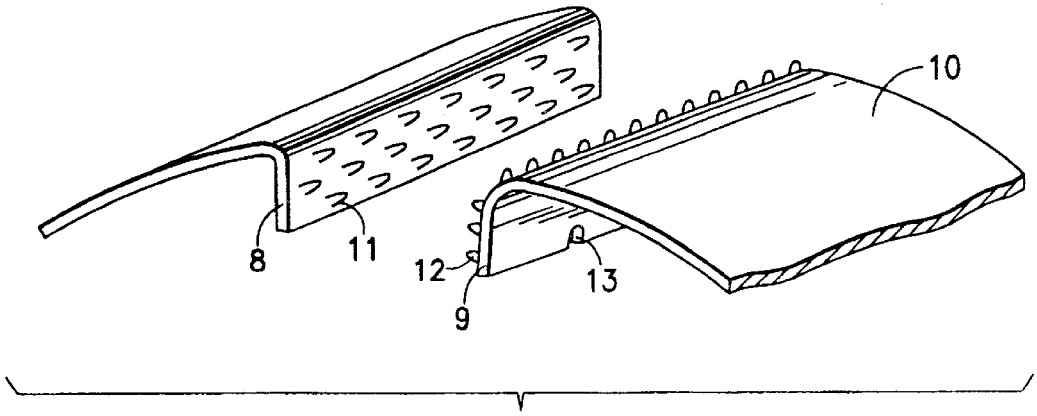
FIG. 3 is a plan view of a printing plate have plate legs connected by hook-and-loop tape.

FIGS. 1 to 3 show, illustrated in part, printing plates which have been bent into a circular shape and whose plate legs, bent over at the edge, are firmly connected to each other. In detail, FIG. 1 shows a printing plate 1 whose leading and trailing plate legs 2 and 3, respectively, are bent over at right angles, rest on each other and, in this region, are connected to each other by electric resistance pressure welding. Electric seam welding is advantageously used to produce a continuous weld 4. However, spot welding is also possible.

FIG. 2 shows a printing plate 5 having leading and trailing plate legs 6 and 7, respectively, bent over obliquely at the edge. Here, the two legs 6, 7 of the plate are bonded over their length using their faces pointing towards each other, for which purpose the rough surface is extremely suitable. In an exemplary embodiment, a liquid adhesive is used, which is applied by means of gun or spray application. The use of double-sided adhesive tape is also possible, the tape being applied first to one of the legs, for example, using a dispenser. The use of hot-melt adhesive is also possible. Following the application of the adhesive or of the adhesive tape, the legs 6, 7 of the plate are joined to each other.

According to FIG. 3, the respective leading and trailing plate legs 8 and 9 of a printing plate 10, and bent over perpendicularly at the edge, and are provided with a hook tape 11 and a loop tape 12 respectively, and pressed onto each other to be joined. In order to illustrate the hook tape 11 and the loop tape 12 better, the printing plate 10 has been illustrated in the unjoined state. The hook-and-loop tape 11, 12 is also known under the terms touch-and-close tape of VELCRO® tape.

The joining of the respectively leading and trailing legs 2, 3 or 6, 7 or 8, 9 of the plate can advantageously be carried out by means of an automatic machine. In such an automatic machine, it is also possible for the legs 2, 3, 6 to 9 of the plate to be aligned axially well, by the printing plates 1, 5, 10 being provided with stamped register tongues 13, with which they are held in the automatic machine. These stamped register tongues have already been used for adjustment during the image-setting of the printing plate 1, 5, 10 previously carried out in the flat state.

In the event of an adequate stiffness, the printing plate 1, 5, 10 brought to circular shape according to FIGS. 1 to 3 is pushed by hand onto an overhung plate cylinder 14 (FIG. 4), without any aids, from the free end of the plate cylinder. This may either be a plate cylinder which is intrinsically overhung, as shown for example in DE 196 24 395 A1, or a plate cylinder which, during printing operation, is mounted in two side walls which can be exposed at one journal and is then overhung, such as shown, for example, in DE 43 15 909 A1. The overhung mounting of the plate cylinder 14 has been shown schematically in FIG. 4 by a hatched frame at its left-hand end. If the stiffness of the printing plate 1, 5, 10 is not adequate, it is pushed onto the plate cylinder 14 with the assistance of a mandrel 15.

Figure 4:
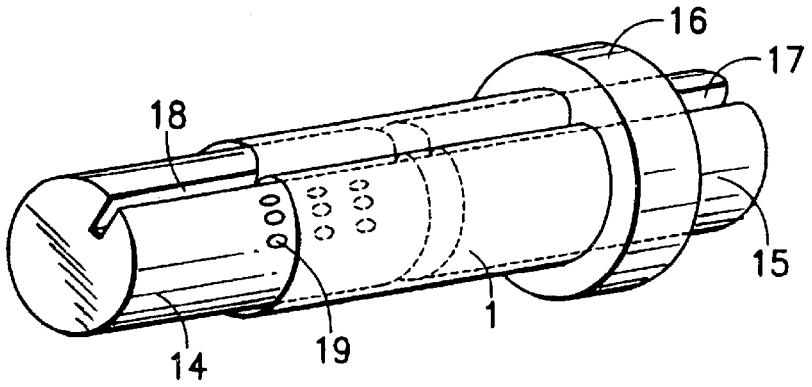
FIG. 4 is a schematic view of the action of pushing a printing plate onto a plate cylinder using a mandrel.

According to FIG. 4, the printing plate 1 is fitted to the mandrel 15. After it has been positioned in alignment with the plate cylinder 14, the printing plate 1 is pushed from the mandrel 15 onto the plate cylinder 14 with the assistance of a sliding ring 16. Both the mandrel 15 and the plate cylinder 14 have a groove 17 and 18, respectively which are appropriately oversized in width and depth in order that the mutually connected legs 2, 3 of the printing plate 1 fit in.

The internal diameter of the sleeve-like printing plate 1 has a dimension smaller than the external diameter of the plate cylinder 14. Therefore, in order to push it on, the printing plate 1 is expanded by means of compressed air. For this purpose, the plate cylinder 14 has blow holes 19, from which compressed air flows. Blowing devices of this type are familiar to those skilled in the art and can be seen, for example, in the aforementioned EP 0 812 686 A2. The hermetic connection of the legs 2, 3 and 6 to 9 of the plate prevents compressed air escaping from this joint. After the pushing-on operation, firm seating of the printing plate 1 on the plate cylinder 14 is achieved by switching off the compressed air. Furthermore, the legs 2, 3 of the plate, which are located in the groove 18, ensure positive securing of the printing plate 1 against moving as a result of slippage. By perpendicularly bending over the plate legs at the edge secures the leg when rolling on a rubber blanket, both in a leading manner and in a trailing manner. In addition, very narrow widths of the groove 18 can be implemented. Leading and trailing plate legs 6, 7 (FIG. 2) which are obliquely bent over in relation to the circumference, offer security against the printing plate 5 slipping out of the gap in the plate cylinder 14 in the event that the adhesive seam does not hold. However, this design variant requires a fixedly predetermined "conveying direction" of a blanket cylinder in the indicated arrow direction P (FIG. 2).

In order to disassemble the printing plate 1 (or 5 or 10), compressed air is again delivered from the blow holes 19 (FIG. 4), resulting in the expansion of the printing plate 1 and enabling the pushing off of the plate from the plate cylinder 14. Depending on whether a detachable connection between the plate legs 3, 4, 6 to 9 was carried out, it is possible for the plate legs 6 to 9 to be separated again, and the printing plate 5, 10 can be transferred again into the flat state.

Instead of the printing plate 1, 5, 10 with its respective plate legs 2, 3 firmly connected to each other, the plate cylinder 14 may also be fitted with a truly sleeve-like printing plate, for example, a sleeve butt-welded from sheet metal, a seamed or seamless sleeve which has been produced by electroplating. The latter sleeves are particularly suitable as printing plates which can be erased and can have a new image set for offset printing, if they are produced from nickel or a nickel alloy, while the printing plates 1, 5, 10 advantageously produced from aluminium according to FIGS. 1 to 3 are not erasable. However, their production from sheet metal made of a nickel alloy is also possible here, and this then provides them with the ability to be erased and have a new image set. The setting of the images on the printing plates 1, 5, 10 can be carried out when the plates are clamped onto the plate cylinder 14 or outside the printing machine. This being advantageously carried out in the latter case when the printing plate is flat, for example by means of copying.

The previous exemplary embodiments and those still to follow are treated with reference to printing plates for offset printing. However, the application of the invention to printing plates for other printing processes, for example for gravure printing, is also possible.

Figure 5:
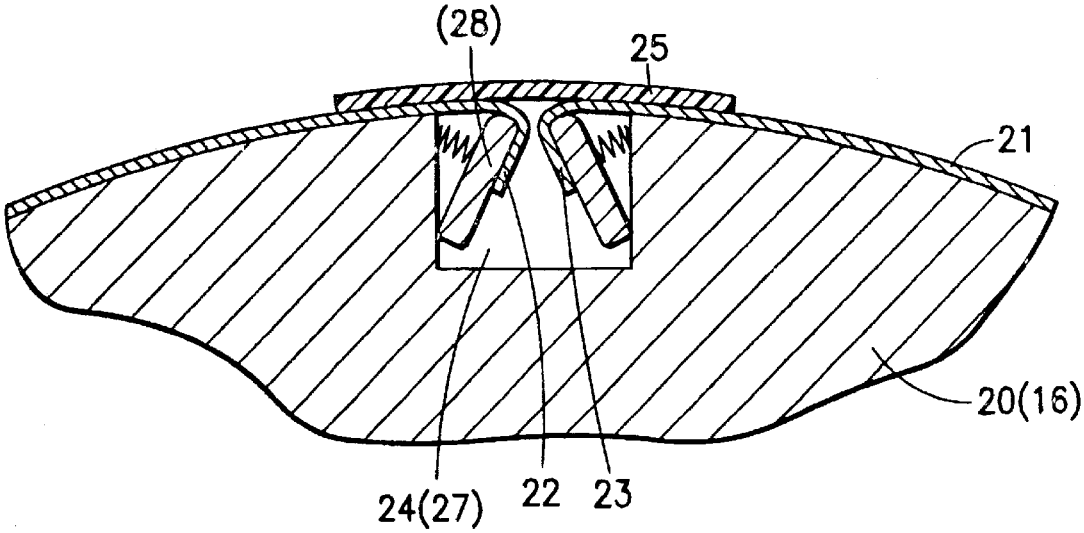
FIG. 5 is a schematic view of a parent cylinder in cross section, with a printing plate held together by adhesive tape.

FIG. 5 shows, in section, part of a parent cylinder 20 having a printing plate 21 laid on it. The leading 22 and trailing 23 legs of the plate 21 having been inserted loosely into a cylinder channel 24 running axially. An adhesive tape 25 is stuck onto the circumferential regions of the printing plate 21 laid on in this way, on either side of the cylinder channel 24, that is to say in the non-printing region. The printing plate 21 prepared in this way and held in the circular shape by the adhesive tape 25 is now pushed off the parent cylinder 20 and pushed onto an overhung plate cylinder 26, which has clamping elements 28 for the leading 22 and trailing 23 plate legs in a cylinder channel 27. For the purpose of simplification, the item numbers for the elements of the plate cylinder 26 have also been indicated, placed in brackets, on the parent cylinder 20, and the clamping elements 28 have been drawn with thin lines. After the printing plate 21 has been pushed onto the plate cylinder 26, the adhesive tape 25 is removed and the printing plate 21 is clamped by means of the clamping elements 28. The parent cylinder 20 is advantageously oversized by comparison with the plate cylinder 26 as a result of which blow holes 19 and therefore blown-air support during the operation of pushing the printing plate 21 onto the plate cylinder 26 can be dispensed with. The application of the adhesive tape 25 does not need to be air-tight either, therefore the latter does not need to be applied continuously over the entire width of the printing plate 21. For the purpose of disassembly, the printing plate 21 can be axially pushed off the plate cylinder 26 after the clamping elements 28 have been loosened.

Although not illustrated, the cylinder channel of a parent cylinder and the bent-over legs of a printing plate can also be configured such that the legs, more or less rest on each other, and have space in the cylinder channel. In this case, a low-viscosity adhesive can be introduced between the adjacent faces of the legs of the plate. The further handling of the flat printing plate shaped into a sleeve in this way is carried out in a manner similar to that shown in FIG. 4 and described in relation to this figure.

Figure 6:
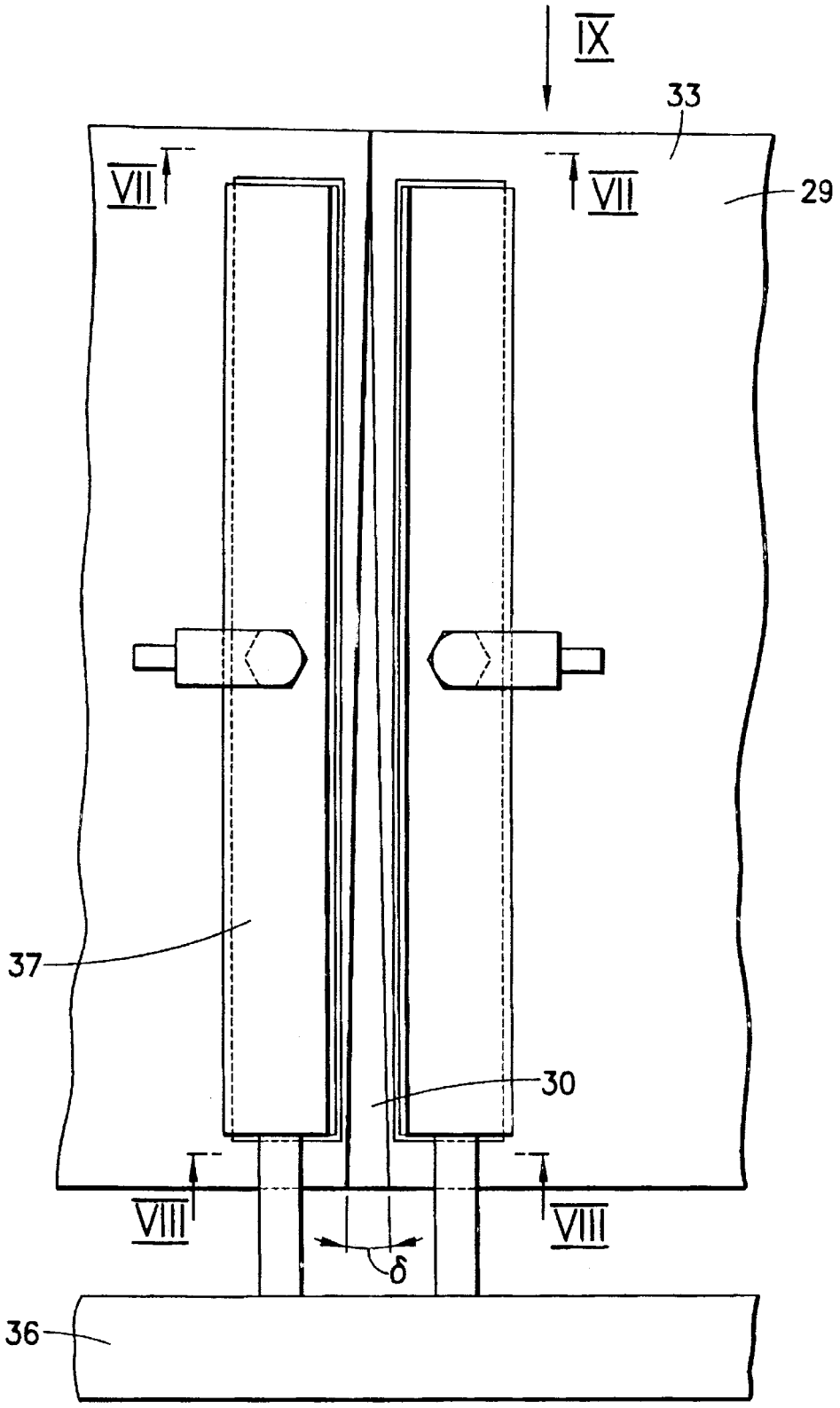
FIG. 6 is a top view of a parent cylinder with slots running towards each other to accommodate the legs of the plate.

FIG. 6 shows part of a parent cylinder 29 having a clamping channel 30 containing two slots 31, 32 (FIG. 7) which are arranged at an acute angle δ with respect to the circumference of the parent cylinder 29, and are disposed in a V-shape with respect to each other and run towards each other at an angle α in the direction in which the printing plate 33 to be fitted is pushed on (FIGS. 7, 8) The angle δ is advantageously chosen to be in the range from 0.1 to 0.2 degrees. The angle α between the slots 31, 32 is about 70 to 90 degrees.

Figure 7:
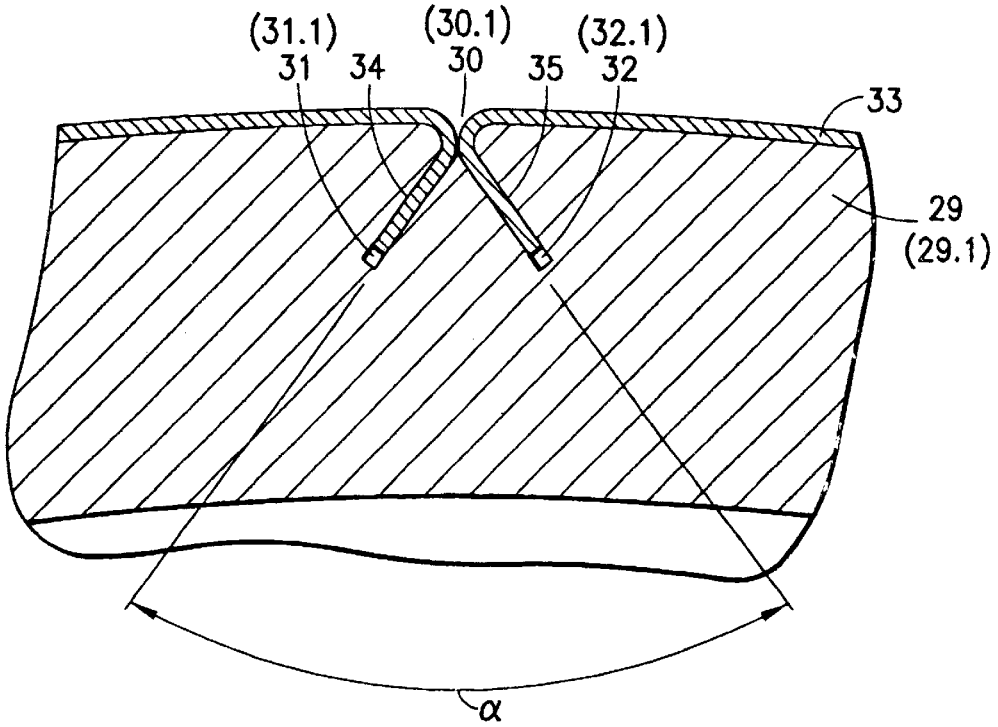
FIG. 7 is a cross-section view of the parent cylinder of FIG. 6 taken along line VII—VII.
Figure 8:
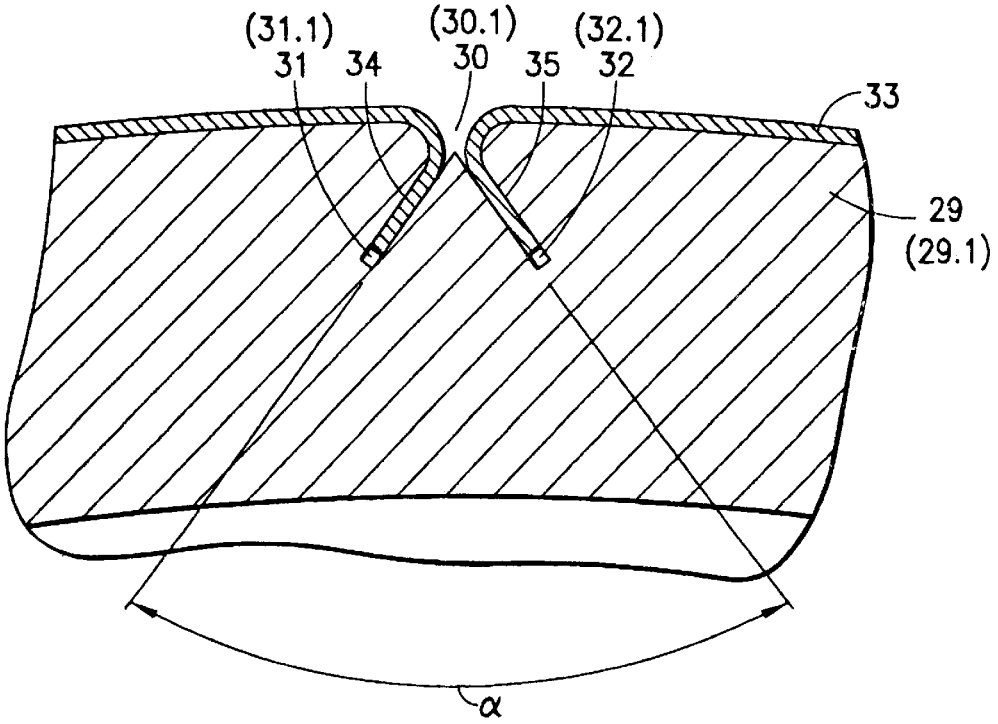
FIG. 8 is a cross-section view of the parent cylinder of FIG. 6 taken along line VIII—VIII.

Referring to FIG. 7, the leading and trailing legs of the printing plate 33 are inserted into the respective slots 31 and 32, and the printing plate 33 is axially pushed onto the parent cylinder 29. The printing plate brought into the circular shape in this way is then drawn off the parent cylinder 29 by means of an apparatus and is pushed onto an overhung plate cylinder 29.1 (which is not illustrated since it resembles the parent cylinder 29), in a manner analogous to the parent cylinder 29. The plate cylinder 29.1 contains a clamping channel 30.1 with slots 31.1, 32.1 running towards one another in the insertion direction. The item numbers of the plate cylinder 29.1 have also been applied to the parent cylinder in FIG. 7, but placed in brackets.

Figure 9:
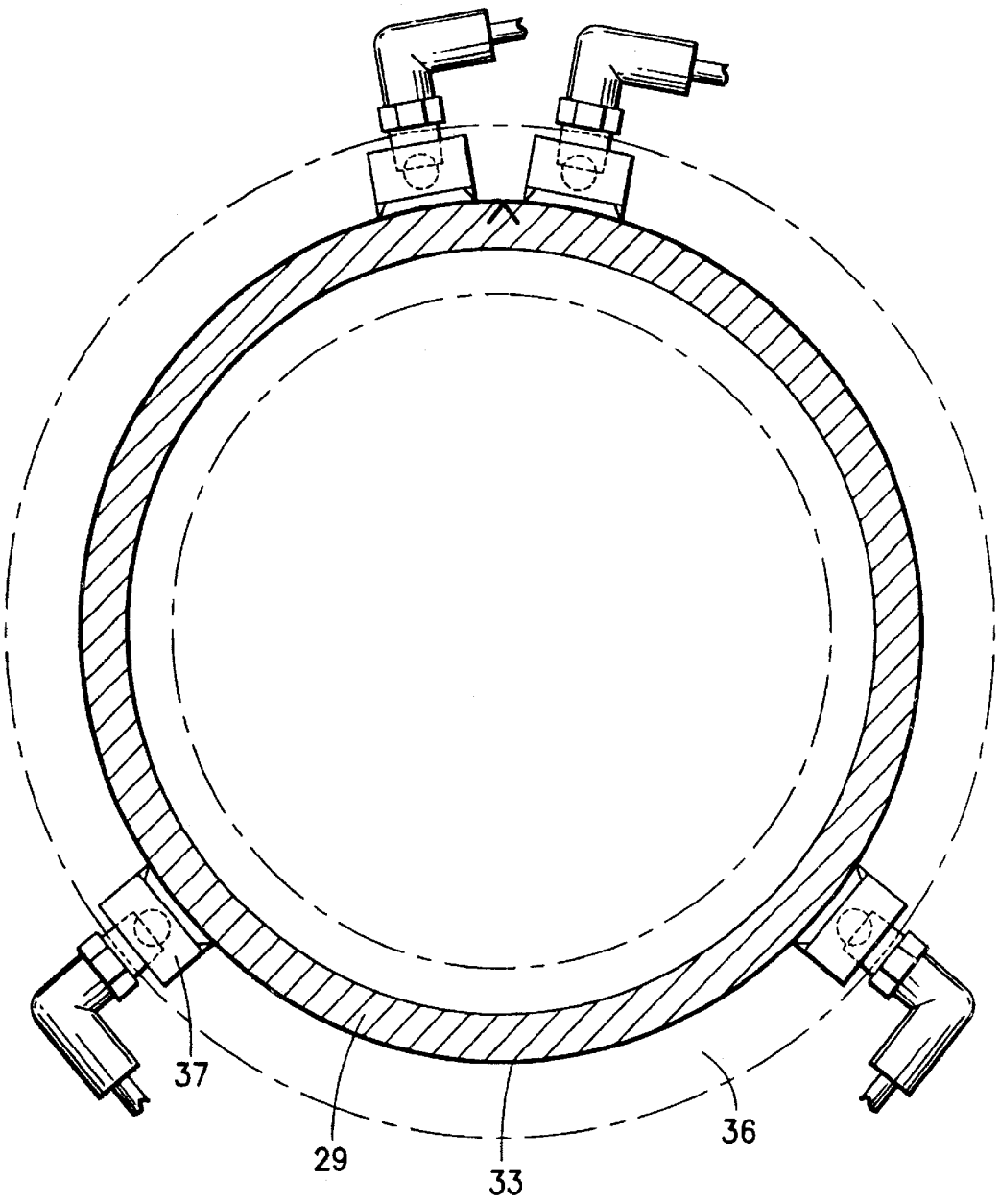
FIG. 9 is an end view of the parent cylinder of FIG. 6 taken along line IX.

The apparatus (FIG. 9) contains a plurality of suction bars 37 arranged on a holder 36 such that with appropriate handling of the holder 36, the suction bars are placed longitudinally on the parent cylinder 29, and distributed around the printing plate 33 on the parent cylinder 29. In this position, the suction bars 37 are connected to a vacuum source and enter into vacuum contact with the printing plate 33. By means of appropriate handling of the holder 36, the printing plate is now drawn off the parent cylinder 29 and pushed onto the overhung plate cylinder 29.1 from the free side of the latter. In the process, the printing plate 33 maintains its circular shape as a result of appropriate arrangement of the suction bars 37 on the holder 36. The parent cylinder 29 is advantageously slightly undersized with respect to the plate cylinder 29.1. The necessary tension for the printing plate 33 is then achieved as it is being pushed onto the plate cylinder 29.1. The operation can also be carried out, as described in earlier examples, with air assistance. For this purpose, the plate cylinder has blown-air openings on the circumference. For the purpose of disassembly, the printing plate 33 is gripped by the suction bars 37 and axially drawn off the plate cylinder 29.1. Although not illustrated, the ends on both sides of the clamping channel 30 of the printing plate 33 on the parent cylinder 29 can also be connected using adhesive tape (analogous to FIG. 5). The printing plate 33 can then be pushed off the parent cylinder 29 and pushed onto the plate cylinder 29.1.

Figure 10:
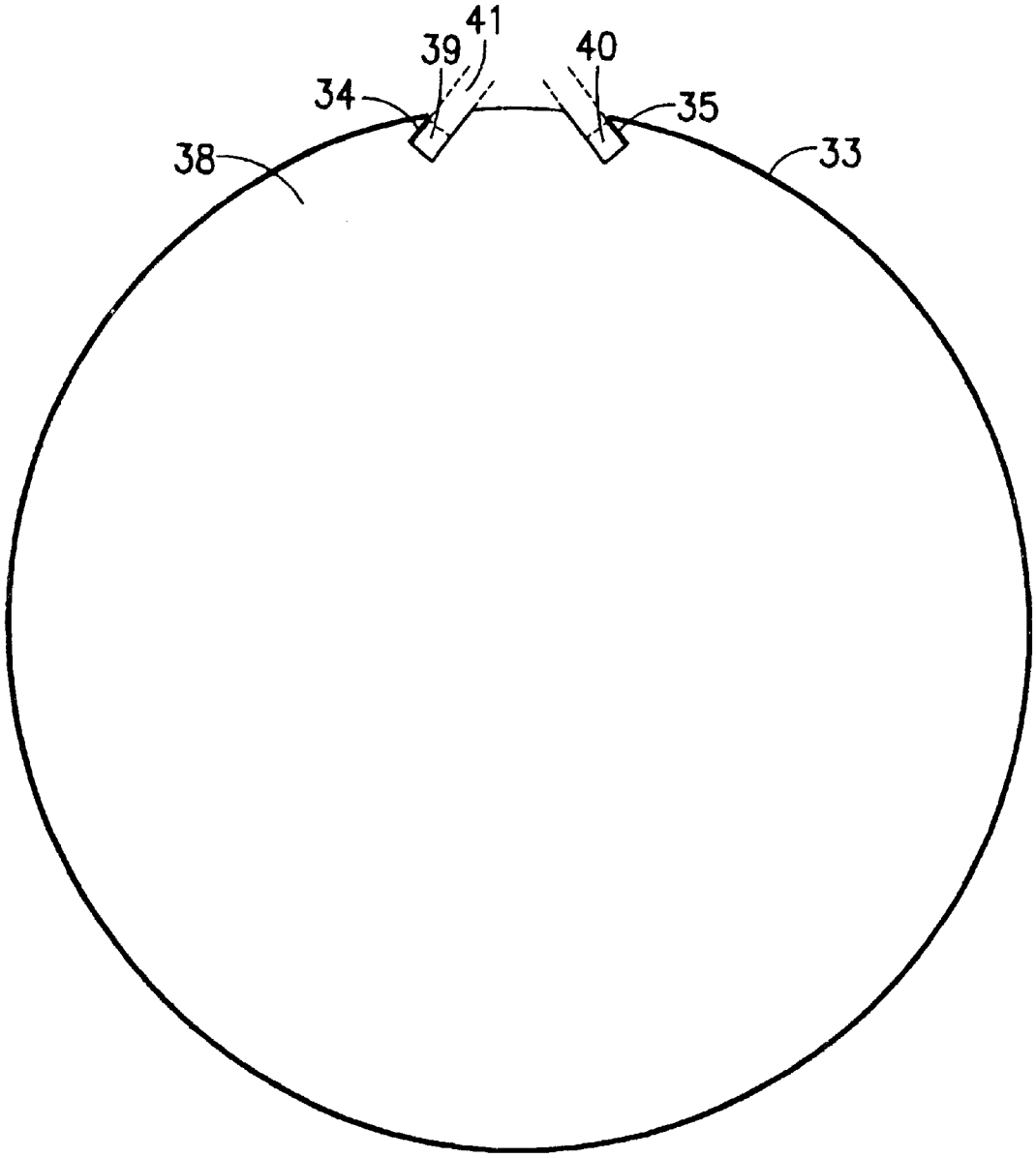
FIG. 10 is an end view of a cylinder for bending over the edges of a printing parent cylinder according to FIG. 6.

FIG. 10 shows an apparatus for bending over the edges of the leading 34 and trailing 35 plate legs of the printing plate 33 according to the preceding exemplary embodiment. For this purpose, the printing plate 33 is wound around a cylinder 38 whose diameter is greater than that of the parent cylinder 29. The cylinder 38 bears two grooves 39, 40 which run in the axial direction and run towards each other at the angle δ at which the slots 31, 32 of the plate cylinder 29.1 are also inclined. The ends of the printing plate 33 placed on in this way are then pressed into the grooves 39, 40 by means of a bar 41 and are bent over, forming the plate legs 34, 35.

Figure 11:
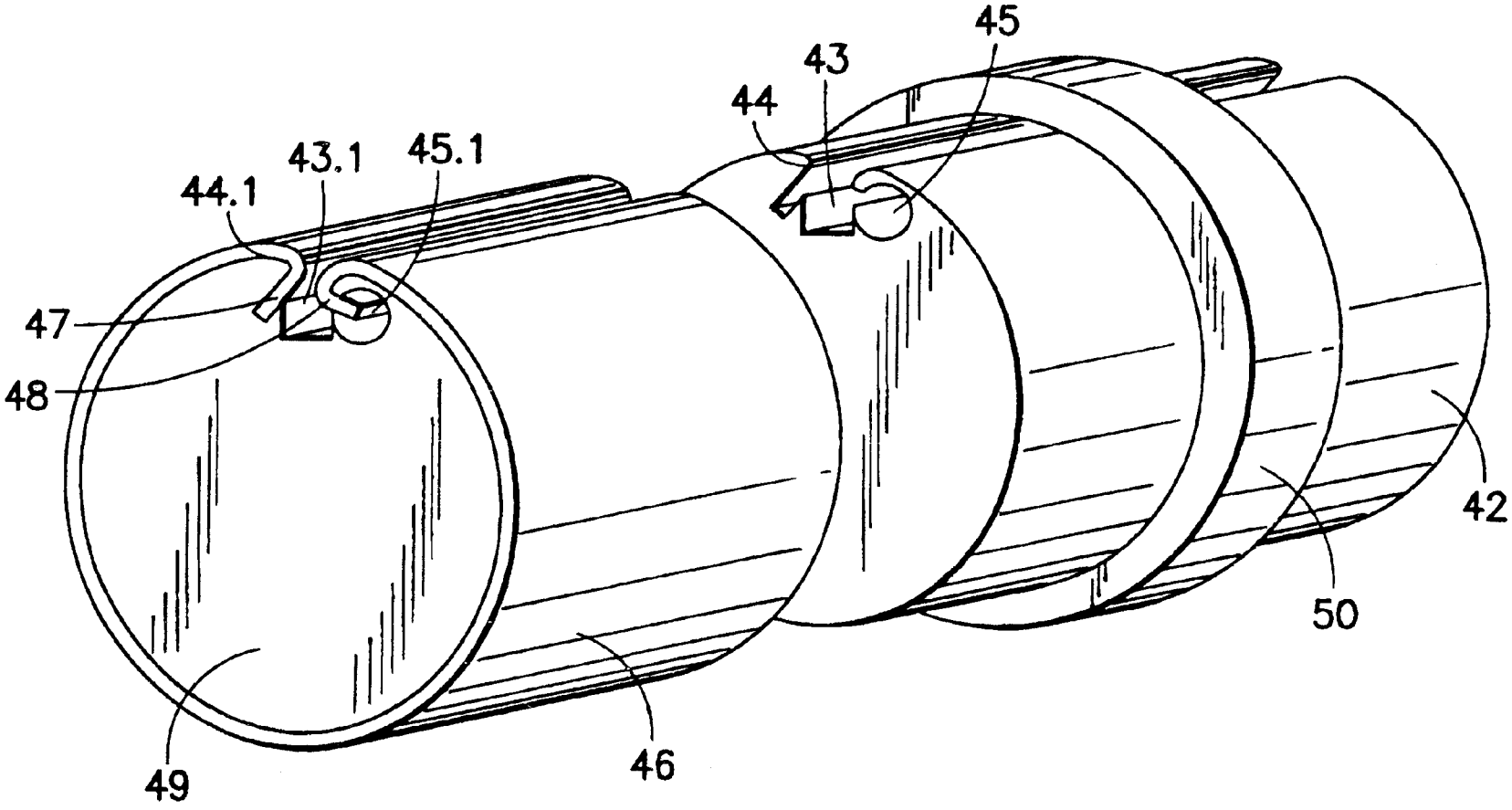
FIG. 11 is a persepective view of a parent cylinder having a plate clamping device, which can be attached to a plate cylinder.

FIG. 11 shows a parent cylinder 42 which, in a cylinder channel 43, has a clamping device which contains, for example, a leading channel edge 44 and a clamping spindle 45. The leading plate leg 47 of the printing plate 46 is hooked into the leading channel edge 44 of the parent cylinder 42 and wound around the latter. The trailing plate 48 is then inserted into a slot in the clamping spindle 45 (not shown). The parent cylinder 42 is then attached at the end to the free end of the overhung plate cylinder 49 (the overhung mounting is illustrated schematically by a hatched frame at the mounting side of the plate cylinder 49). The plate cylinder 49 has an identical clamping device to that of the parent cylinder 42, having a leading channel edge 44.1 and a clamping spindle 45.1 in a cylinder channel 43.1. When the parent cylinder 42 is fitted to the plate cylinder 49, the clamping devices, that is to say the leading channel edges 44 and 44.1 and the clamping spindles 45 and 45.1, are brought into alignment. The parent cylinder 42 can be held on the plate cylinder 49, for example, by means of magnetic force or a closure device.

For easier handling, the parent cylinder 42 can be of lightweight design, or else can be brought up to the plate cylinder 49 by an apparatus. The printing plate 46 is pushed onto the plate cylinder 49 from the attached parent cylinder 42, advantageously with the aid of a sliding ring 50. In the process, the leading plate leg 47 is pushed onto the leading channel edge 44.1, and the trailing plate leg 48 is pushed into the slot in the clamping spindle 45.1. The printing plate 46 positioned on the plate cylinder 49 can then be clamped by operating the clamping spindle 45.1. Disassembly of the printing plate 46 is carried out after the clamping spindles 45.1 have been loosened by axially pushing the printing plate 46 off the plate cylinder 49.

In all the applications, the plate cylinders 24, 26, 29.1, 49 can advantageously have a stop which limits the amount to which the printing plate 1, 5, 10, 21, 33, 46 is laterally pushed on, and thus brings the printing plate into side register as it is pushed on.

The invention is not limited by the embodiments described above which are presented as examples only but can be modified in various ways within the scope of protection defind by the appended patent claims.

We claim:

1. A method for fitting a flat offset printing plate having a leading and a trailing plate leg to an overhung plate cylinder of a rotary printing machine comprising the steps of:

fitting the printing plate to a parent cylinder by inserting the leading and trailing legs into a cylinder channel running axially in a circumference of the parent cylinder;

fixing the leading and trailing legs of the printing plate in the cylinder channel with regard to positions they have assumed in relation to each other;

removing the printing plate from the parent cylinder in the axial direction;

axially pushing the printing plate onto the plate cylinder from a free end of the plate cylinder;

clamping the printing plate on the plate cylinder; and providing said plate cylinder with two slots arranged at an acute angle to the circumference of the plate cylinder, said slots being disposed in a V-shape with respect to each other and running toward each other at an angle in an insertion direction, said leading and trailing legs being pushed into said slots.

2. A method for fitting a flat offset printing plate having a leading and a trailing plate leg to an overhung plate cylinder of a rotary printing machine comprising the steps of:

fitting the printing plate to a parent cylinder by inserting the leading and trailing legs into a cylinder channel running axially in a circumference of the parent cylinder;

fixing the leading and trailing legs of the printing plate in the cylinder channel with regard to positions they have assumed in relation to each other;

providing suction bars around the printing plate on the parent cylinder;

bringing the suction bars into vacuum contact with the printing plate; and drawing the printing plate off the parent cylinder and pushing the printing plate onto the plate cylinder using said suction bars;

clamping the printing plate on the plate cylinder; and providing said plate cylinder with two slots arranged at an acute angle to the circumference of the plate cylinder, said slots being disposed in a V-shape with respect to each other and running toward each other at an angle in an insertion direction, said leading and trailing legs being pushed into said slots.

3. An overhung plate cylinder of a rotary printing machine and an apparatus for fitting a flat offset printing plate having leading and trailing legs to the overhung plate cylinder, said apparatus comprising:

a parent cylinder for receiving the printing plate in a substantially cylindrical shape;

a clamping device disposed in said parent cylinder for maintaining said printing plate in the cylindrical shape; and means for displacing the printing plate from the parent cylinder and onto the plate cylinder while maintaining the clamped cylindrical shape, wherein said parent cylinder further comprises a circumference, two slots arranged in an axial direction at an acute angle with the circumference and being disposed in a V-shape with respect to each other and running toward each other in an insertion direction, the leading and trailing legs of the printing plate adapted to be pushed into said slots, wherein said plate cylinder further comprises slots corresponding to said parent cylinder slots;

said means for displacing further comprising:

a plurality of suction bars extending in a longitudinal direction of said parent cylinder and positioned so as to be distributed around the printing plate on the parent cylinder;

a holder for fastening said plurality of suction bars in place, wherein the printing plate is adapted to be axially drawn off said parent cylinder by said plurality of suction bars and pushed onto the plate cylinder, the leading and trailing legs adapted to be pushed from the parent cylinder slots into the plate cylinder slots.

4. The apparatus in accordance with claim 3, wherein said clamping device of said parent cylinder enables loose clamping of the printing plate around the parent cylinder, and the plate cylinder comprises a plate cylinder clamping device, wherein a free end of said parent cylinder is attached to a free end of the plate cylinder such that said parent cylinder clamping device is aligned with said plate cylinder clamping device, and wherein the printing plate is adapted to be axially pushed off said parent cylinder out of the parent cylinder clamping device and onto the plate cylinder and into the plate cylinder clamping device.

5. A device for attaching a flexible printing form on a form cylinder of a rotary printing machine, the device comprising a cylinder body and axially running slit-shaped canals in the outer surface of the cylinder body in which folded ends of the printing form are adapted to be axially slidably inserted in an insertion direction, the two slit-shaped canals being disposed in a V-shape with respect to each other and running toward each other in the insertion direction, wherein the ends of the printing plate are adapted to be axially pushed in the slit-shaped canals.

6. The device of claim 5, wherein said two slit-shaped canals run toward each other at an angle within the range of 0.1 to 0.2 degrees.

7. The device of claim 5, wherein said two slit-shaped canals are arranged in a V-shape at an angle within the range of 70 to 90 degrees from each other.

* * * * *